US006643874B1

(12) United States Patent
Geglein

(10) Patent No.: US 6,643,874 B1
(45) Date of Patent: Nov. 11, 2003

(54) PYRAMIDAL SEAT CUSHION

(76) Inventor: Robert A. Geglein, 7839 Woodruff Rd., Cincinnati, OH (US) 45255

( * ) Notice: Subject to any disclaimer, the term of this patent is extended or adjusted under 35 U.S.C. 154(b) by 0 days.

(21) Appl. No.: 10/303,437

(22) Filed: Nov. 25, 2002

Related U.S. Application Data

(63) Continuation-in-part of application No. 09/545,116, filed on Apr. 7, 2000, now abandoned.

(51) Int. Cl.[7] ..... A47C 16/00; A47C 20/02

(52) U.S. Cl. ..... 5/654; 5/653; 5/655.3; 5/656; 297/181; 297/452.23; 297/452.41; 297/DIG. 3

(58) Field of Search ..... 297/219.1, 181, 297/452.26, 452.21, 1, 3, 283.1, 452.41, DIG. 3, 452.23; 5/653, 654, 633, 420, 655.3, 656

(56) References Cited

U.S. PATENT DOCUMENTS

| | | | | | |
|---|---|---|---|---|---|
| 1,156,523 | A | * | 10/1915 | Clemens | 5/654 X |
| 1,673,636 | A | * | 6/1928 | Perry | 5/655.3 |
| 1,935,485 | A | * | 11/1933 | Reynolds | 297/219.1 X |
| 4,371,985 | A | * | 2/1983 | Pokhis | 5/655.3 |
| 4,459,714 | A | * | 7/1984 | Lin | 5/655.3 |

FOREIGN PATENT DOCUMENTS

| | | | | |
|---|---|---|---|---|
| DE | 3613766 | A1 | * 11/1987 | A47C/9/00 |

* cited by examiner

*Primary Examiner*—Anthony D. Barfield
(74) *Attorney, Agent, or Firm*—Neal O. Willmann

(57) ABSTRACT

The inflatable cushion, pyramidal in shape, with a protective back flap, disclosed herein is relatively soft, conformable, and easy to transport. It is remarkable in its ability to facilitate sitting on a sloping surface by providing an enhanced measure of security, stability and comfort.

5 Claims, 3 Drawing Sheets

FIG. 1
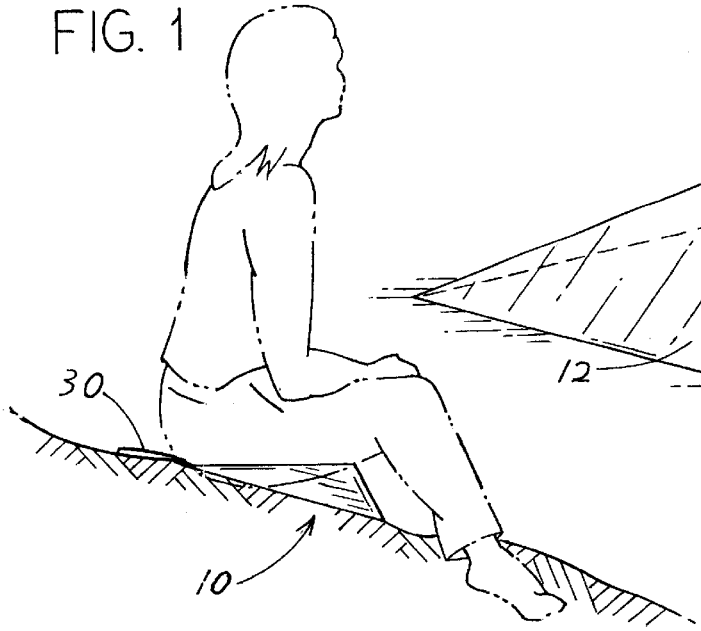
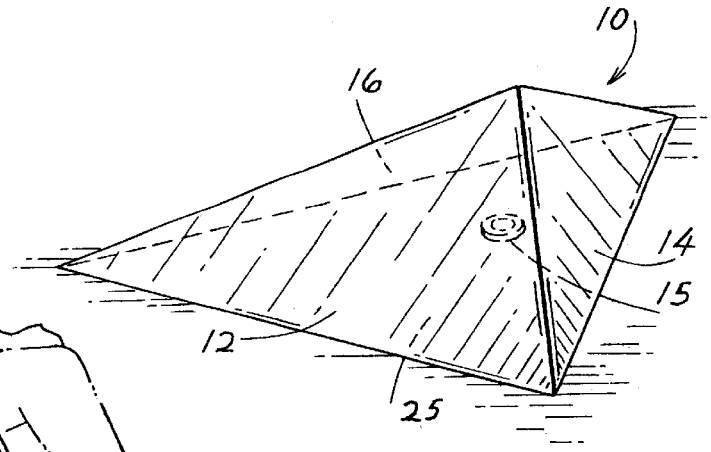
FIG. 2
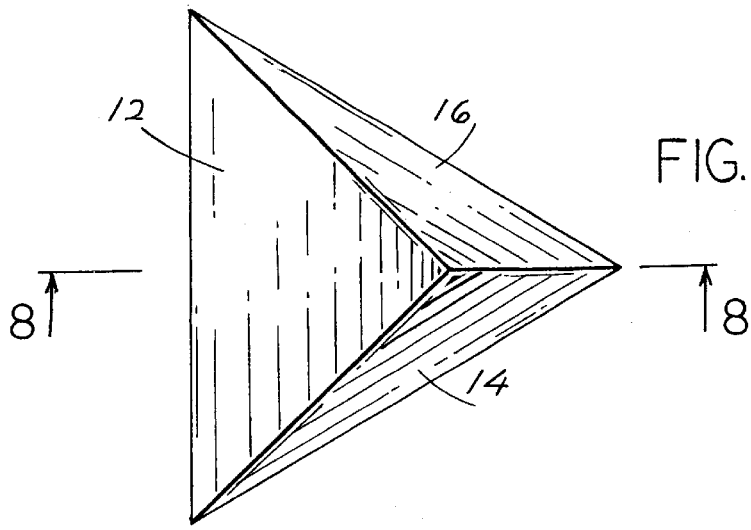
FIG. 3
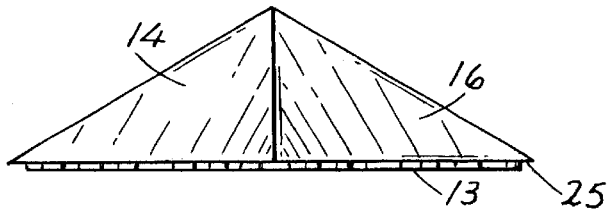
FIG. 4

FIG. 5
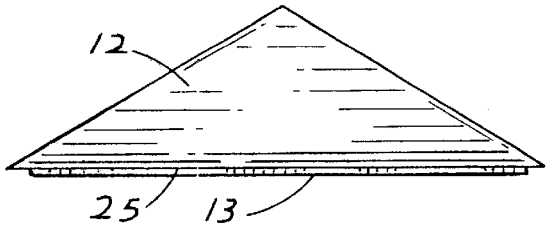
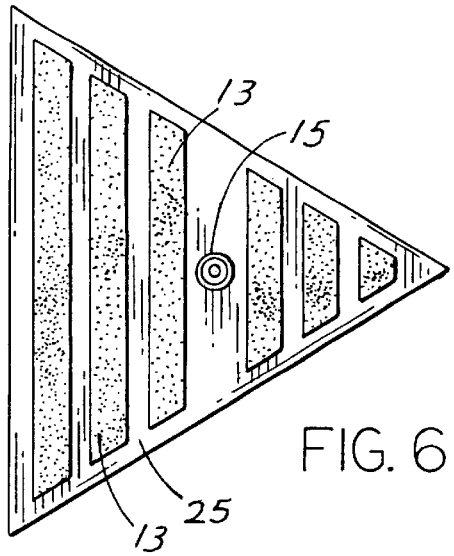
FIG. 6
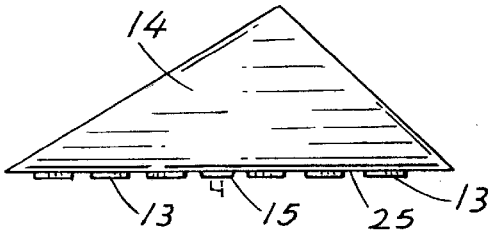
FIG. 7
FIG. 8
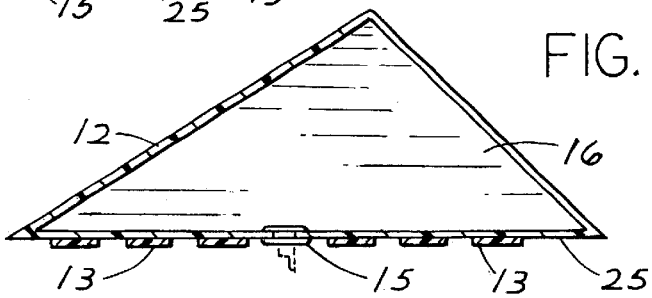
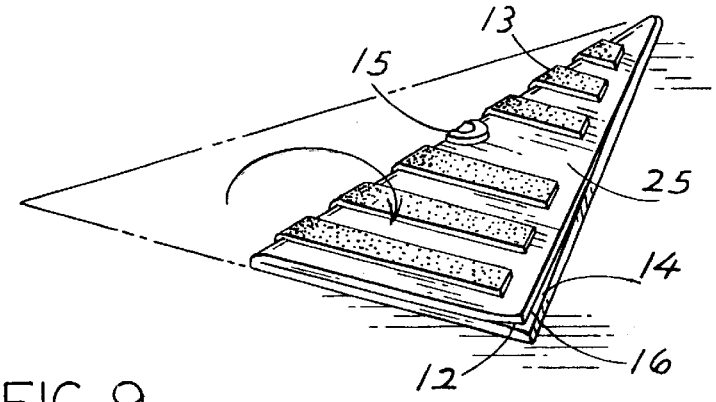
FIG. 9

PYRAMIDAL SEAT CUSHION

CROSS-REFERENCE TO RELATED APPLICATION

This Application is a continuation-in-part of U.S. patent application Ser. No. 09/545,166 filed Apr. 7, 2000 now abandoned.

FIELD OF THE INVENTION

The disclosed invention relates generally to a sitting cushion and more particularly to a transportable sitting cushion that can be used out-of-doors, especially where the ground surface is gently sloping. The disclosed cushion is specifically designed to provide a comfortable seat for use while watching or engaging in sporting, entertainment or recreational events where the open or available seating is like that of the sloping lawn of an amphitheater or the bank of a favorite fishing stream.

SUMMARY OF THE INVENTION

This disclosure relates to a cushion for sitting, with a fair degree of security and comfort, on a sloping surface. The cushion is pyramidal in shape, having four triangular surfaces and a back flap to insulate or protect the sitter's coccyx area from contact with the natural or ambient environment. The disclosed seat cushion is ideally fabricated from a molded thermoplastic material that can be readily inflated to assume a pyramidal shape by expiration into a valve molded onto one of the triangular surfaces. The four triangular surfaces of the cushion are the pyramidal base surface for encountering the slope upon which the user of the cushion desires to sit, and three upper triangular surfaces, including a sitting surface and two lateral surfaces to support the sitting surface. The back flap originates from the juncture of the sitting surface and the base surface.

BRIEF DESCRIPTION OF THE DRAWING

FIG. 1 is a pictorial depiction of the disclosed pyramidal cushion in use on a sloping hillside.

FIG. 2 is an elevated transparent perspective view of the pyramidal cushion.

FIG. 3 is a top plan view of said cushion.

FIG. 4 is a front elevational view of said cushion.

FIG. 5 is a rear elevational view thereof.

FIG. 6 is a bottom plan view thereof.

FIG. 7 is a elevational view thereof, both sides being identical.

FIG. 8 is an enlarged cross-sectional view of the pyramidal cushion taken along line 8—8 of FIG. 3 showing the air chamber and wall thickness.

FIG. 9 is a perspective view of the pyramidal cushion deflated and folded.

DESCRIPTION OF THE PREFERRED EMBODIMENT

Figure 10:
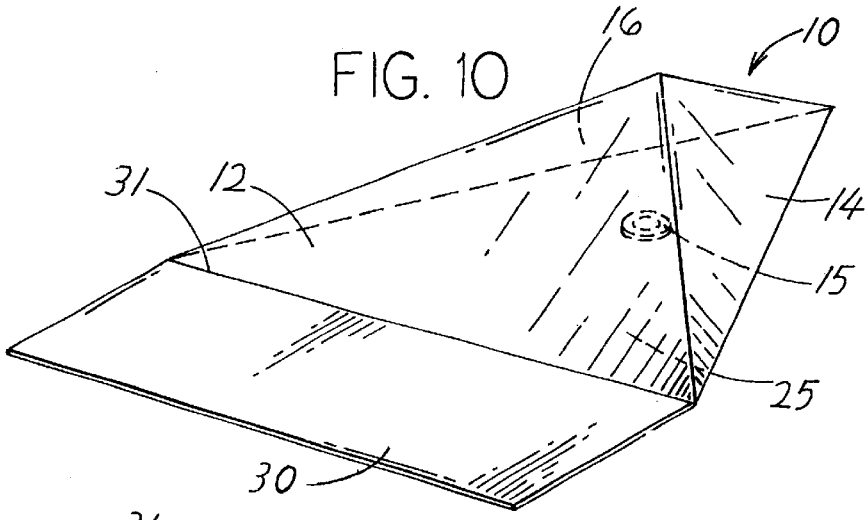
FIG. 10 is an elevated transparent perspective view of a preferred embodiment of the pyramidal cushion featuring a back flap.

Several preferred embodiments of the disclosed cushion can be elaborated upon with clarity and understanding by referring to the drawing. FIG. 1 is a depiction of the cushion 10, in transparency, being used on a sloping surface. Examples of sloping surfaces benefiting from the use of the disclosed cushion include hillsides, riverbanks, and natural amphitheaters. An example of an industrial use of the disclosed cushion is in the roofing industry where, with the exception of flat roofs, a secure sitting surface is a valuable enhancement to the work environment.

For further elaboration on the shape and design of disclosed cushion, reference can be made to FIG. 2. Shown here in transparency to illustrate the hidden base 25 and left lateral surface 16, the pyramidal shape of the cushion 10 is readily apparent. Also apparent are the sitting surface 12 and the right lateral surface 14.

In preferred embodiments of the pyramidal cushion 10, it has been observed that the greatest comfort and security can be achieved by introducing some inequality in the relative sizes of the triangular surfaces of the pyramidal seat cushion. While all the pyramidal surfaces are generally rectangular in shape, it is desirable that the base surface 25, which is to be situated directly upon the slope to be sat upon, be larger than the other three pyramidal surfaces. It has also been found to be desirable that the sitting surface 12 be larger than the lateral support surfaces 14 and 16. This configuration of the relative sizes of the pyramidal surfaces is, of course, not absolutely essential to the use of the cushion, but, to reiterate, taking this liberty with the classic pyramidal shape seems to provide the greatest comfort and security for the user.

Additional enhancements to the shape and structure of the basic design of the cushion can also be made to improve its use and durability. For instance, on the base 25, it may be desirable to alter the surface to introduce a gripping surface 13 to impart additional stability to the cushion. Currently, adhesive strips having an abrasive texture are easily applied or affixed to the surface of the base subsequent to the molding process. These non-slip strips have proven to be more than adequate to increase friction between the cushion and the sloping surface.

Returning to the drawing and FIG. 3, it is apparent from the depiction that, in this instance, the two lateral surfaces 14 and 16 are preferably equal in size. This equality will generally ensure that the sitting surface 12, which is supported by the lateral surface be as horizontally flat or level as possible, given the conditions of the prevailing environment. The equality of the size and shape of the lateral surfaces 14 and 16 is further illustrated in the front elevational view afforded by FIG. 4.

FIG. 5 presents additional insight into the construction and design of the cushion. In this rear elevational view, it may be apparent that the sitting surface 12 is preferably larger than the individual lateral surfaces. FIG. 6 presents a clear view of the base surface 25 and the non-slip strips 13 that are ideally adhered to the base surface 25. Also apparent is the valve 15, which is used for inflating and deflating the cushion, and which is preferably positioned on the base surface 25 to situate it as unobtrusively as possible. Typically, the quantity of air needed to inflate the cushion is small enough so that it can be inflated easily by expiration. FIG. 7 provides an additional illustration showing a side view of the cushion and a phantom depiction of the valve 15 in an open mode. FIG. 8 is a cross-sectional view of the cushion 10 showing the thickness of the walls, especially of the sitting surface 12.

Figure 11:
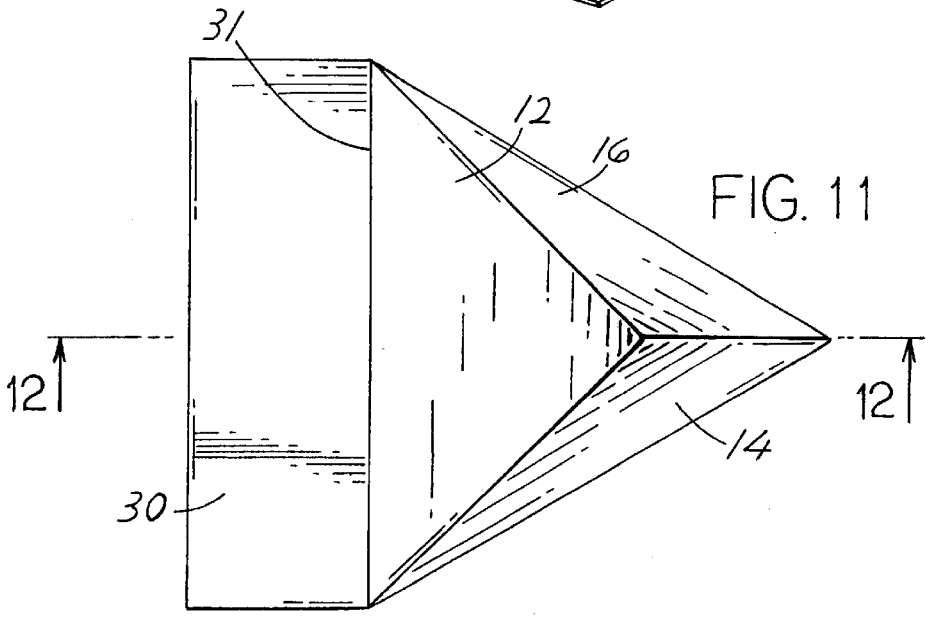
FIG. 11 is a top plan view of the embodiment of FIG. 10.
Figure 12:
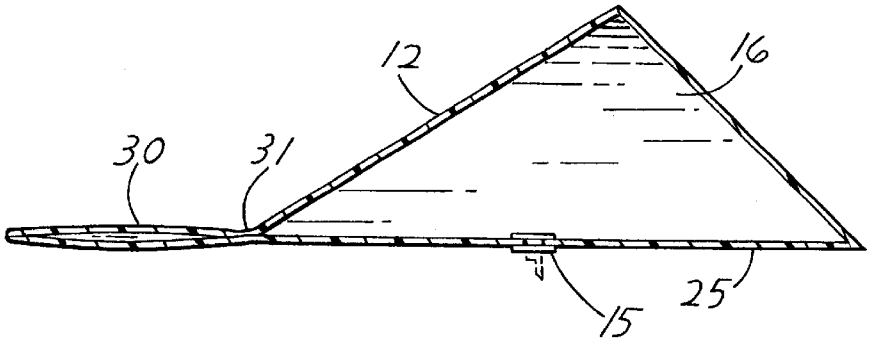
FIG. 12 is a cross-sectional view of the preferred embodiment of the pyramidal cushion taken along line 12—12 of FIG. 11.

FIG. 9 illustrates the cushion 10 in a completely deflated mode and demonstrates how easily it can be folded and, of course, transported to the site or venue of use. In FIGS. 10, 11 and 12, a most preferred embodiment of the disclosed cushion is set forth. Specifically, in the course of development, it has been observed that a back flap or skirt 30, when appended to the cushion 10, preferably at the juncture 31 of the sitting surface 12 and the base surface 25, provides additional traction, stability to the cushion, and a measure of protection to the sitter's coccyx area. The protection or insulation afforded is typically from wet, slippery, damp or cold ground and, in some instances, from grass stains. The flap or skirt 30 can be of any size or shape, but preferably, it should to be large enough to extend up a slope and provide protection or insulation to the sitter between the buttocks and the waist. The shape is of little importance to the function of the cushion; and, therefore, it could be rectangular, as depicted, or semi-circular, or any other effective shape. It is only important that the back flap originate at the juncture 31 of the base surface 25 and the seat surface 12 and extend sufficiently to protect the sitter's coccyx area.

In the most probable embodiment of the pyramidal cushion, the back flap 30 will be fabricated from a double sheet of material, and ideally, made from the same material as the pyramidal aspect of the cushion. The double-sheet configuration of the back flap results primarily from the preferred method of manufacture. More specifically, the back flap is typically formed by extending the base and seat surfaces and sealing or welding the two surfaces at juncture 31. As a result of this manufacturing method, the back flap will not be inflatable. But, clearly, the back flap could be fabricated in a way to allow measured amounts of inflated air to flow from the pyramidal portion of the cushion and through breaches in the juncture 31 to effect inflation, if desired. But, clearly, at this time the inflation of the back flap remains only an option.

Even though the foregoing is a complete and detailed description of the preferred embodiments of the disclosed pyramidal cushion, it should be apparent that numerous variations and modifications could be employed to implement the all-important purpose of the cushion without departing from the essence of the invention. It is the essence and spirit of the disclosed cushion which are fairly defined by the appended claims.

What I claim is:

1. An inflatable cushion, pyramidal in shape, said cushion comprising four triangular surfaces, including a base surface having the largest area of the four surfaces; a sitting surface; two lateral support surfaces identical in shape and size; a back flap originating from the juncture of said base surface and said sitting surface; and a valve for inflating said cushion.

2. The cushion according to claim 1 wherein the sitting surface forms an isosceles triangle.

3. The cushion according to claim 1 wherein the two support surfaces are scalene triangles.

4. The cushion according to claim 1 wherein the back flap is inflatable.

5. The cushion according to claim 1 wherein the back flap is rectangular in shape.

* * * * *